United States Patent [19]

Aasland

[11] 4,178,650

[45] Dec. 18, 1979

[54] SELF-WRINGING MOP

[76] Inventor: Reuben E. Aasland, 31900 Happy Valley Dr., Indio Hills, Calif. 92240

[21] Appl. No.: 360

[22] Filed: Jan. 2, 1979

[51] Int. Cl.[2] ..... A47L 13/142

[52] U.S. Cl. ..... 15/120 R

[58] Field of Search ..... 15/120 R, 120 A, 263

[56] References Cited

U.S. PATENT DOCUMENTS 2,668,970 2/1954 Cooper ..... 15/120 R

*Primary Examiner*—Edward L. Roberts

*Attorney, Agent, or Firm*—Albert M. Herzig; Edward C. Walsh

[57] ABSTRACT

A self-wringing mop having a head which is attached to a handle and having a mop holder for holding a mop unit with a crank carried by the head which can be turned for wringing the mop. Improvements reside in a clamping member configurated to be received by the head and which clamps the mop holder to the head with the crank having a crank pin which passes through the clamp member and the head and to which is attached a stem forming part of a mop spreader at the other end of the mop unit. The number of parts is reduced and are of simplified construction providing for ease of fabrication and assembly. The parts are held together by way of the crank pin on the crank which is secured to the stem on the mop spreader.

7 Claims, 7 Drawing Figures

32
10
31
30
12
26
34
36
100
14
52
93
20
101
91
90
102
60
103
94
92

90
61
60
53
52
36
26
30
12
66
71
62
28
3
3
71'
63
40
46
47
42
20
22
14
34
31
32
70
72
74
61'
53'

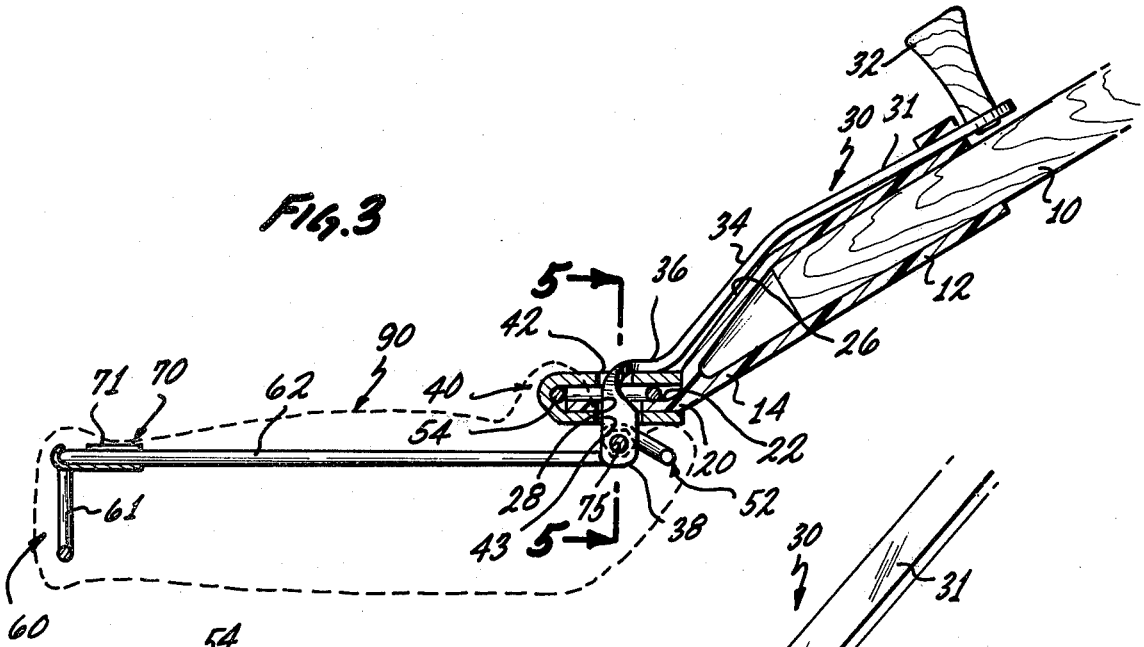
FIG. 3
FIG. 5
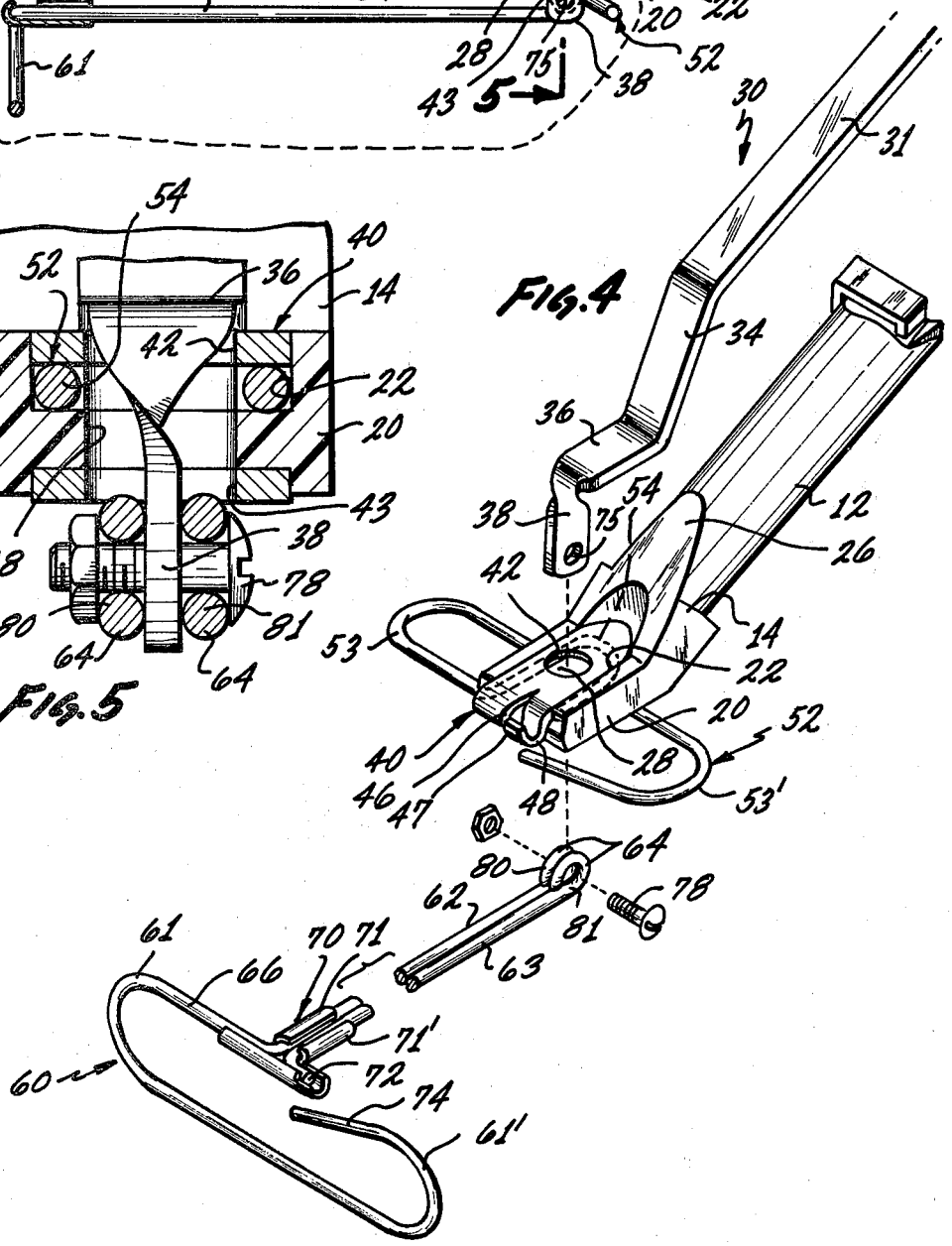
FIG. 4

SELF-WRINGING MOP

BACKGROUND OF THE INVENTION

1. Field of the Invention

The field of the invention is that of self-wringing mops, and more particularly, that type of mop wherein a mop unit or mop cloth is provided at the end of the head and is mounted so that one end of it can be turned or twisted by way of a crank for wringing.

2. Description of the Prior Art

The prior art is exemplified in U.S. Pat. No. 2,668,970 which discloses a mop of the same or a similar type. The mop of the prior patent lacks the unique features of the herein invention in that the herein invention provides a mop having fewer parts, parts that are of simpler construction and which are easier to fabricate and assemble.

SUMMARY OF THE INVENTION

The mop of the invention is described briefly in the abstract. The mop head in the exemplary form of the invention is a single unitary part which may be a plastic part formed by an injection molding process. The end of the mop head is configurated by way of having formations to receive a clamping member which fits into the formations and which clamps a wire mop holder to the head, the wire mop holder having a U-shaped configuration which fits into a secondary formation or recess in the end of the mop head and which is clamped to the mop head. A crank is provided having a crank pin which extends through an aperture in the clamping member and through the end of the head and which is secured to a stem on the mop spreader, which is a wire member at the opposite end of the stem.

The mop spreader can be turned or twisted by the crank for wringing the mop. The mop spreader also is formed of a wire member. Both the mop holder member and the mop spreader, as stated, are formed of wire members, and each has a free end. The free end of the mop holder is attachable to the clamping member to form a closed loop, and similarly, the wire spreader member has a free end which is attachable to a fitting at the juncture of the spreader and the stem so that a closed loop is provided.

The primary object of the invention is to make available a self-wringing mop of the type described which is constructed of fewer parts which are simplified and which are parts readily adapted to easy fabrication and easy and economical to assemble.

A further object is to realize a self-wringing mop as in the foregoing object wherein a wire mop holder for the mop unit is provided that is clamped to the mop and a wire mop spreader member, both of these members providing means to allow easy threading of a mop cloth or mop unit on to them with means to close the holding loops to prevent the mop holder or cloth from coming off.

Further objects and additional advantages will become apparent from the following detailed description and annexed drawings.

BRIEF DESCRIPTION OF THE DRAWINGS

FIG. 3 is a sectional view taken along the line 3—3 of FIG. 2 with the mop unit shown in outline;

FIG. 4 is an exploded view illustrating the parts of the improved mop;

FIG. 5 is a sectional view taken along the line 5—5 of FIG. 3;

DESCRIPTION OF THE PREFERRED EMBODIMENT AND BEST MODE OF PRACTICE OF THE INVENTION

Figure 1:
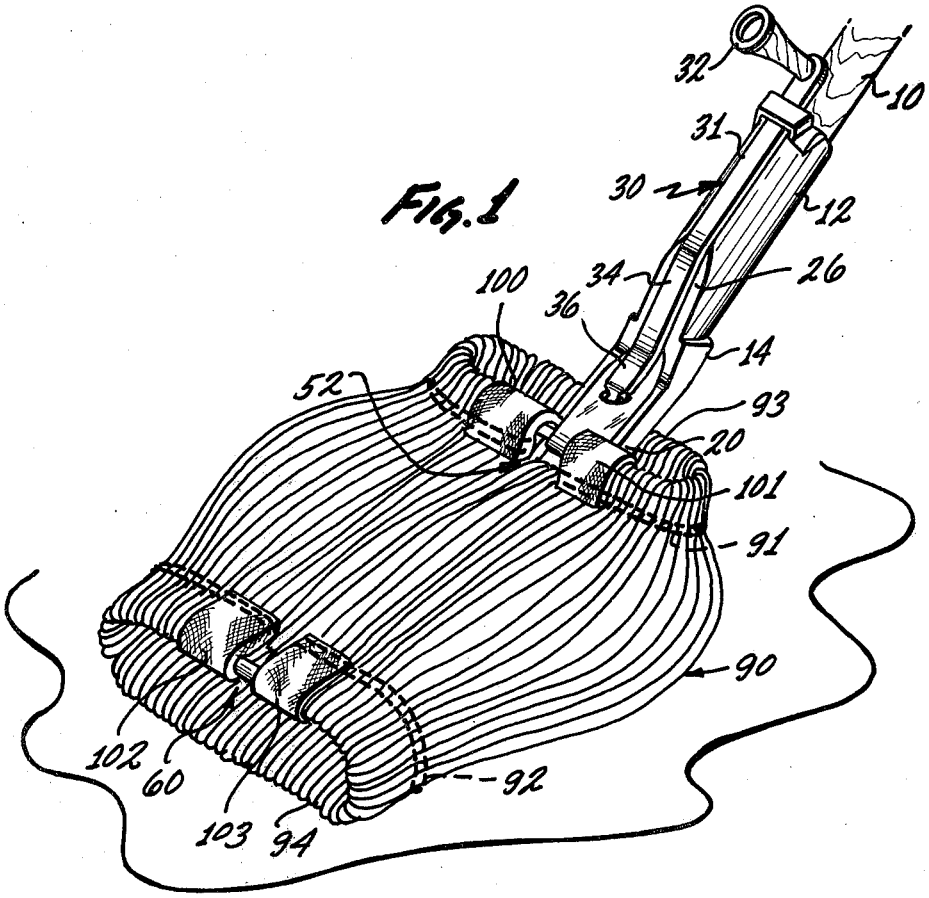
FIG. 1 is a pictorial view of the improved self-wringing mop of the invention.

Referring to the various figures of the drawings, FIG. 1 is a pictorial view showing the improved mop which has a handle 10 which fits into a ferrule 12 formed in a unitary mop head 14 which may preferably be formed of plastic by an injection molding process. The mop head 14 has an end part as designated at 20 which has generally flat sides and a flat bottom surface, and formed in the upper surface is a U-shaped groove or surface 22. The end part 20 is at an angle to the ferrule 14, as shown, the end part of the ferrule being flattened, as shown, at 26.

Provided in the end part 20 of the head is an aperture 28 which extends directly through it, the aperture being between the side parts of the groove or recess 22.

The mop is provided with a crank as designated at 30, the crank having a crank handle 31 at the end of which is a handle or knob 32. The crank 30 has a bend in it, as shown, the crank having a flattened part 34 which conforms to the flattened upper surface 26 of the head 14. At the lower end of the crank 30, it has a flat part 36, as shown, and at the end of this part, the end of the crank is bent through 90° and twisted through 90° to form a crank pin 38 which, in the assembled configuration, extends through the aperture 28.

Figure 2:
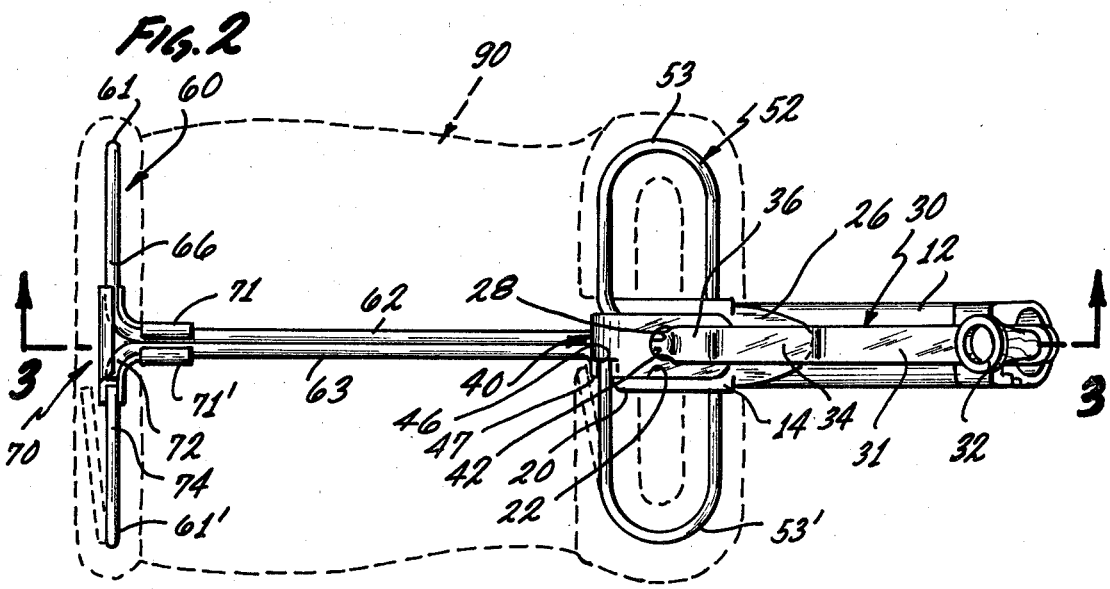
FIG. 2 is a plan view of the mop showing the mop cloth or mop unit in outline.

Numeral 40 designates a clamping member which is preferably formed of metal and which is of U-shape so as to fit over the end part 20 of the head 14. The clamping member 20 is apertured, as shown, at 42, both legs of the U-shaped member having an aperture, as shown, one being designated at 42 and one at 43. The bight of the clamping member 40 has a cut 46 in it, as shown, and at one side of this cut, the metal 48 of the member is bent to form a hook 47, as shown, for a purpose as will presently be described. The top and bottom of end part 20 are recessed to provide configurations or conformations to receive the clamping member 40 so its surfaces become substantially flush with the top and bottom of part 20 as may be seen in FIG. 2.

Numeral 52 designates a wire mop holder for holding one end of the mop or mop unit, which will be referred to presently. The mop holder 52 is bent, as shown, to provide two lateral loops designated at 53 and 53', and one end of it is bent into a U-shape 54 configurated to fit into the recess 22 in the part 20 of the head 14.

Numeral 60 designates a mop spreader for holding the other end of the mop unit. It is formed of wire, as is the mop holder, and is configurated to provide laterally extending loop parts 61 and 61'. One end of the wire of the mop spreader extends at right angles to the loop to the spreader, as shown as designated by the numeral 62. Adjacent to the wire 62 is a similar wire 63, the ends of these two wires being bent into the loop, as shown at 64. The other end of the wire 63 is bent at a right angle so as to be aligned with a part 66 of the loop 61, as shown.

Numeral 70 designates a metal fitting which has a part bent around the part 66 of the loop 61 and which has a second right angle part, the edges of which are bent up around the wires 62 and 63, as shown at 71–71' so that it forms a fitting holding wires 62 and 63 together. The parts of the fitting that engage the wire part 62 and the right angle end part of the wire 63, as designated at 72, are open at the top so that an end part is available to have seated in it a free end 74 of the side loop 61', for a purpose that will be presently described.

Figure 6:
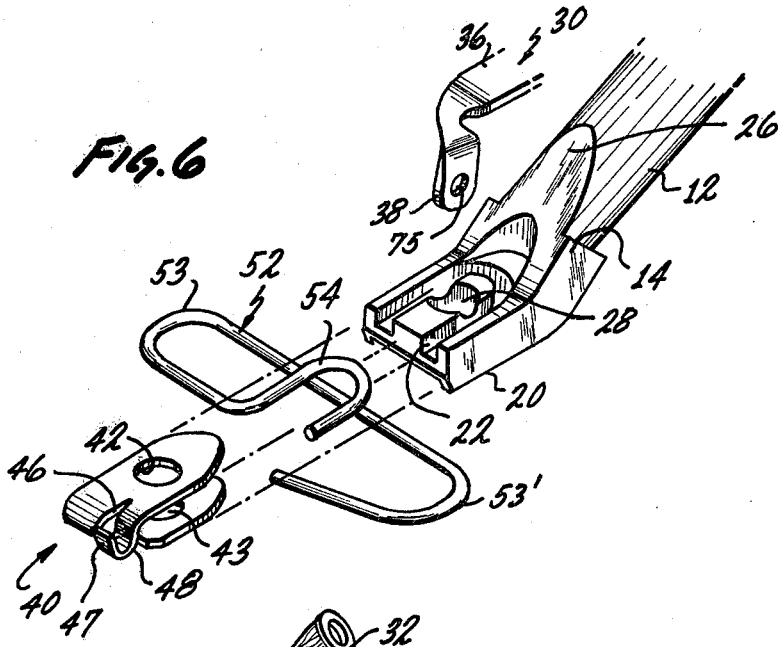
FIG. 6 is a further exploded view showing the parts which are attachable to the mop head.
Figure 7:
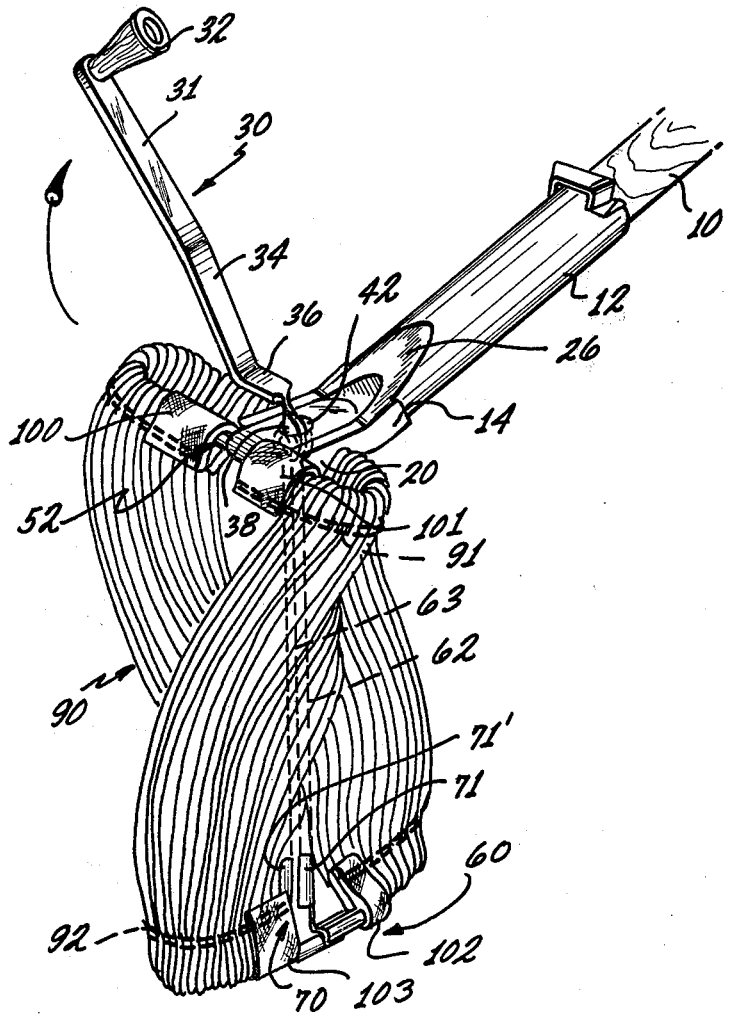
FIG. 7 is an illustrative pictorial view illustrating the manner of usage of the mop to wring the mop unit.

The parts as have been described are assembled in a manner as illustrated in the figures, particularly the exploded views FIGS. 4 and 6 and the cross-sectional view, FIG. 5. The crank pin 38 extends through the apertures 42 and 43 in the clamp 40 and through the aperture 28 in the end part 20 of the head 14. The loop part 54 of the mop holder 53 is fitted into the similarly configurated groove 22 in the surface of the end part 20 of the head 14. The clamp 20 of U-shape is then fitted over the end of the end part 20 of the head 14 so that the loop 54 is clamped between it and the bottom of the groove 22 in the part 20. As may be seen, the end part 20 of the head 14 is configurated to receive the clamp 40, with the surfaces of the clamp then becoming flush wth the top and bottom surfaces of the end part 20 and with the loop 54 securely clamped. The crank 38 then extends through the apertures 42 and 43 in the clamp member 20 and through the aperture 28 in head 20. The end of the crank pin 38 has an aperture 75 and stem 62–63 is bolted to it by bolt 78 with grommets 80 and 81 on opposite sides of crank pin 38.

From the foregoing, those skilled in the art will readily understand the nature and construction of the invention, the manner of assembly of its parts and the manner in which the foregoing stated objects are realized. The construction is extremely simple. The number of parts is minimized. Each part has a very simple construction, proving for ease of fabrication. The assembly is very simple. The parts are held in assembled relationship simply by way of the securement of the crank pin to the stem on the mop spreader. The result is a very sturdy, but economical and useful product, having great utility for any and all purposes that mops are used for.

The foregoing disclosure is representative of a preferred form of the invention and is to be interpreted in an illustrative, rather than a limiting sense, the invention to be accorded the full scope of the claims hereto.

What is claimed is:

1. In an improved self-wringing mop of the type having a head, a crank having a crank pin journaled in the head, a mop holder carried by the head, a mop spreader having a stem, one end of the stem being secured to the crank pin, the improvements comprising a clamping member configurated to engage an end part of the head and to clamp the mop holder to the head, the clamping member having aperture means for the crank pin, the crank pin extending through the clamping member and a registering aperture in the head.

2. A mop as in claim 1 wherein the said mop holder is in the form of a wire member having a portion configurated to engage the end part of the head, the end part of the head being configurated to receive the said portion of the mop holder and then to receive the said clamping member.

3. A mop as in claim 2 wherein the end of the said head has a recess to receive the clamping member, the said recess further having a secondary recess configurated to receive the said portion of the mop holder in between a surface of the head and the clamping member.

4. A mop as in claim 1 wherein the clamping member is of U-configuration shaped to fit onto the end part of the head, the end part of the head being configurated to receive it.

5. A mop as in claim 1 wherein the mop holder is formed of wire having laterally extending loop portions, one loop portion having a free end, the said clamping member having a portion configurated whereby the said free end maybe engageably secured thereto or released therefrom.

6. A mop as in claim 1 wherein said spreader is formed of a wire element including laterally extending loop parts one of said loop parts having a free end, a fitting positioned at the juncture of the said mop spreader and the said stem, the said fitting having a configuration constructed to provide for the securement of the free end thereto or release of the free end therefrom.

7. A mop as in claim 1 wherein said mop spreader is formed of a wire member having laterally extended loop portions the wire members extending from the loop portions and forming said stem.

* * * * *